US011930872B2

(12) United States Patent
Perez Camberos

(10) Patent No.: US 11,930,872 B2
(45) Date of Patent: Mar. 19, 2024

(54) BATHING SUIT WITH GIRDLE

(71) Applicant: Liz Alejandra Perez Camberos, Tijuana (MX)

(72) Inventor: Liz Alejandra Perez Camberos, Tijuana (MX)

( * ) Notice: Subject to any disclaimer, the term of this patent is extended or adjusted under 35 U.S.C. 154(b) by 0 days.

(21) Appl. No.: 17/498,993

(22) Filed: Oct. 12, 2021

(65) Prior Publication Data

US 2023/0113641 A1 Apr. 13, 2023

(51) Int. Cl.

| | |
|---|---|
| ***A41D 7/00*** | (2006.01) |
| ***A41B 9/06*** | (2006.01) |
| ***A41C 1/00*** | (2006.01) |
| ***A41C 1/06*** | (2006.01) |
| ***A41C 1/08*** | (2006.01) |

(52) U.S. Cl.

CPC ..... *A41D 7/00* (2013.01); *A41B 9/06* (2013.01); *A41C 1/00* (2013.01); *A41C 1/06* (2013.01); *A41C 1/08* (2013.01)

(58) Field of Classification Search

CPC ..... A41D 7/00; A41D 2400/38; A41C 1/00; A41C 1/06; A41C 1/08; A41C 3/08; A41B 9/04

See application file for complete search history.

(56) References Cited

U.S. PATENT DOCUMENTS

| | | | | |
|---|---|---|---|---|
| 2,583,865 | A * | 1/1952 | McIlhinney | A41D 7/00 450/8 |
| 2,661,002 | A * | 12/1953 | Silverman | A61F 5/01 450/102 |
| 3,036,574 | A * | 5/1962 | Jeffrey | A41D 7/00 450/30 |
| 5,762,535 | A | 6/1998 | Nishiyama et al. | |
| 6,766,533 | B1 * | 7/2004 | Meier | A41D 7/00 450/133 |
| 8,870,624 | B2 * | 10/2014 | Hopkins | A41C 3/08 450/23 |
| 10,709,177 | B2 | 7/2020 | Shoemaker | |
| 2005/0064790 | A1 * | 3/2005 | Mone | A41F 15/002 450/7 |
| 2012/0266347 | A1 * | 10/2012 | DiLorenzo | A41D 7/00 450/95 |
| 2016/0353812 | A1 * | 12/2016 | Shoemaker | A41B 9/04 |
| 2017/0318864 | A1 * | 11/2017 | Carroll | A41B 9/04 |

* cited by examiner

*Primary Examiner* — Megan E Lynch
*Assistant Examiner* — Giao Qt Hoang
(74) *Attorney, Agent, or Firm* — Defillo & Associates, Inc.; Evelyn A. Defillo

(57) ABSTRACT

The present invention relates to a bathing suit/swimsuit type garment with an integrated shaping-girdle configured to apply pressure to users' tissue or skin. Likewise, the girdle integrated in the bathing suit of the present invention can come into contact with water (such as swimming pools, sea, lagoons, etc.), without compromising its shape, integrity, and/or compression capacity, moreover the girdle of the present invention is discreetly and integrally incorporated into a one-piece swimsuit/bathing suit design with snaps.

1 Claim, 16 Drawing Sheets

BATHING SUIT WITH GIRDLE

FIELD OF THE INVENTION

The present invention relates to the field of garment manufacturing. Specifically in the field of garments used in the practice of swimming or sunbathing on the beach. In particular, the invention relates to a bathing suit type garment that has an integrated shaping girdle configured to apply pressure to the tissue or skin of a user.

BACKGROUND OF THE INVENTION

Girdles are commonly used by women who have the need or desire to give an attractive body shape, however these girdles are made to be worn under clothing, so usually they lack any design and therefore, they cannot be worn by the user in, for example, a beach or pool.

Similar products have been found in the state of the art, for example, U.S. Pat. No. 5,762,535 describes a garment made of flexible material configured to adapt to the body of a user and for compressing the hips, buttocks, abdomen and chest, avoiding limiting or restricting the movement of the body of the user; which can be applied in the form of a swimsuit, which can also be full body (one piece), slip (bikini type), shorts, blouse (upper body), etc. Likewise, U.S. Pat. No. 10,709,177 discloses a complete bathing suit (one piece) for women that includes an upper girdle-like portion (bodice or corset), upper-body compression, and a lower briefs-type portion. Said upper portion allows to adapt and compress the abdomen and chest of the user (in a similar way to a girdle) and said lower portion is adjusted to the body of the user by means of connectors. The bathing suit can be placed in a simple way since it does not require getting on or wearing like a conventional one-piece suit, its adjustment means allow it to adapt to the user's body, as well as to adjust it to a desired compression.

Said inventions have different disadvantages, basically that these and other commercial products do not include means of adjustment, for example, through snaps that are used after the bathing suit is placed on the body of the user. In other words, the existing products do not have any adjustment component other than the fabric itself, so the user will have to pull the suit into its final position by forcing it up.

SUMMARY OF THE INVENTION

In order to overcome the deficiencies of the state of the art, the present invention provides a bathing suit-type garment that includes a girdle, which can come into contact with water (pools, sea, lagoons, etc.), without compromising its shape, integrity, and/or compression capacity. What is more, the girdle in the bathing suit is integrated discreetly and completely in a design preferably of a one-piece bathing suit/swimsuit with means of fastening such as hook and loop, hooks, zipper but more specifically at least one row of snaps. In other words, the bathing suit is divided into different layers which will be explained in detail below.

The bathing suit of the present invention can be used by a postpartum or postoperative patient, since the integrated girdle also allows the return of the organs and/or tissues to their original position, as well as reducing inflammation or bruising, edema and/or fluid retention resulting from a surgical intervention and/or childbirth, in addition to provide support to the abdomen and back, helping to reduce the pain and discomfort that may be generated and without limiting the movement of the user or causing circulatory complications during use. Moreover, the present invention is not limited to use in postpartum or postoperative users, it can also be used by users without any surgical intervention, caesarean section or natural birth with the purpose of reducing size and/or shaping the body figure, showing a stylized figure like "hourglass" as well as improving the wearer's posture.

In another objective of the present invention, the girdle included in the bathing suit comprises lower sections in the lower back area where there is an open area such as a pair of holes for the buttock, which allows the wearer's region to be accommodated to give greater firmness to said area of the body. In addition, the girdle will provide better support in the lower back allowing the gluteal area to stand out, creating firmness in the gluteal area.

Another objective of the present invention is to provide a bathing suit with an integrated shaping-girdle, which functions as a compression garment that applies the necessary amount of pressure on the tissue or skin of the trunk area (back and abdomen) of the user, and at the same time helps reduce fluid retention. Likewise, the present invention is comfortable and simple to use since it allows free movement while supporting the muscles of the buttocks, trunk and back.

These and other objectives will be apparent to those of ordinary skill in the art to which the present invention pertains, based on the following detailed description, the accompanying figures, as well as the appended claims.

BRIEF DESCRIPTION OF THE FIGURES

Figure 1A:
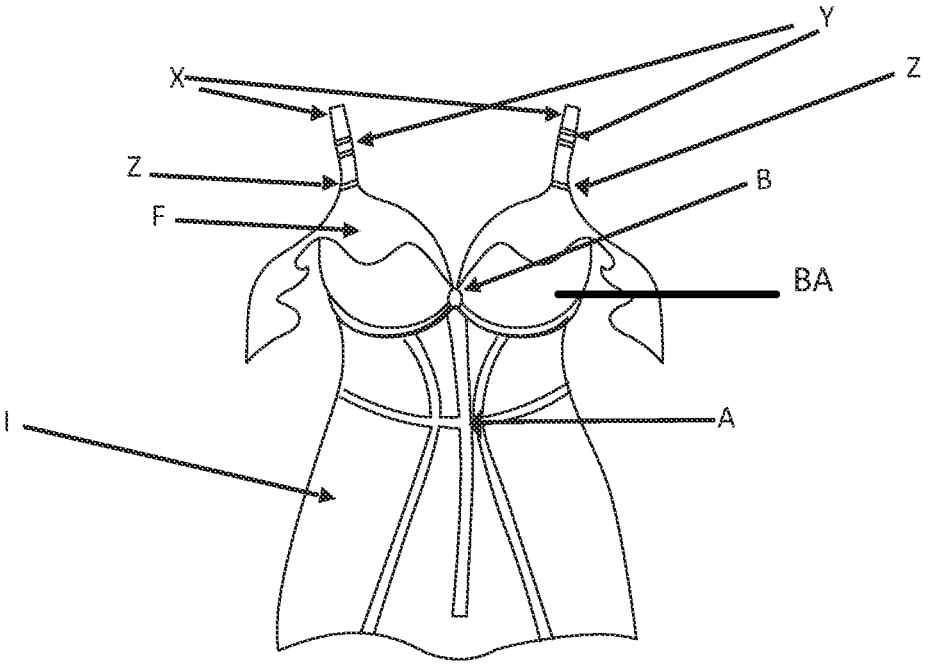
Figure 1B:
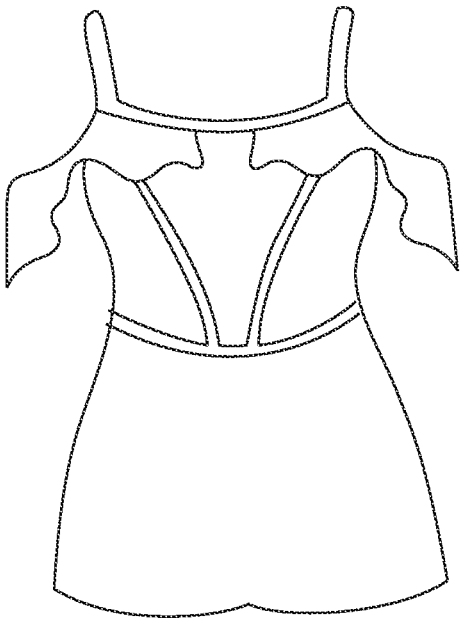
Figure 2A:
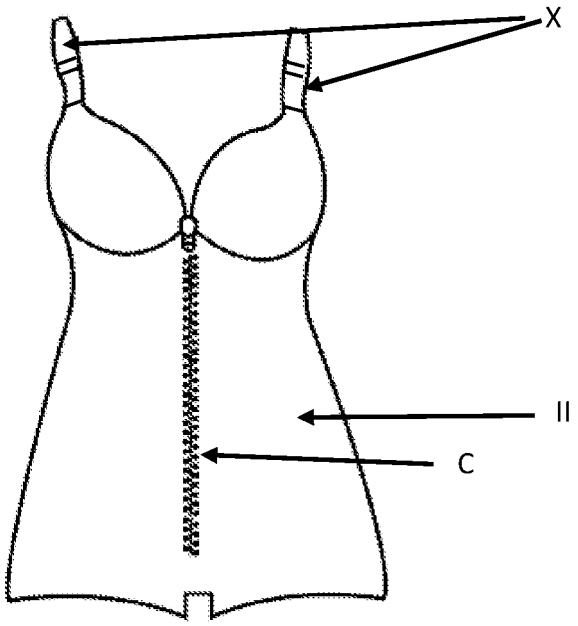
Figure 2B:
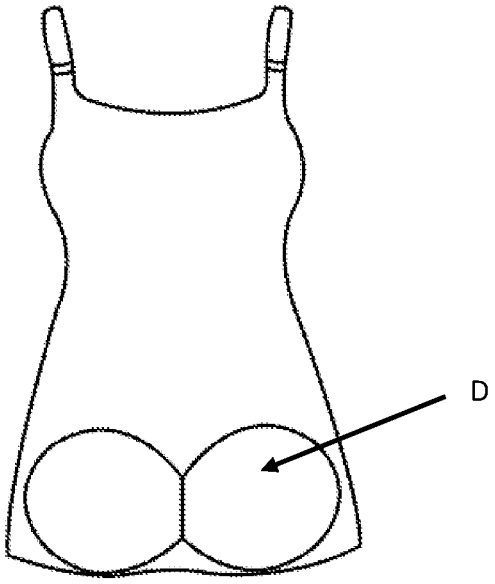
Figure 3:
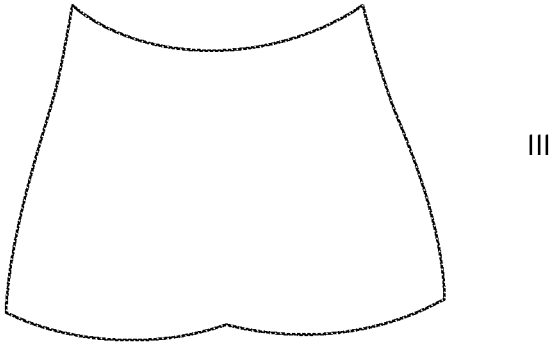
Figure 4:
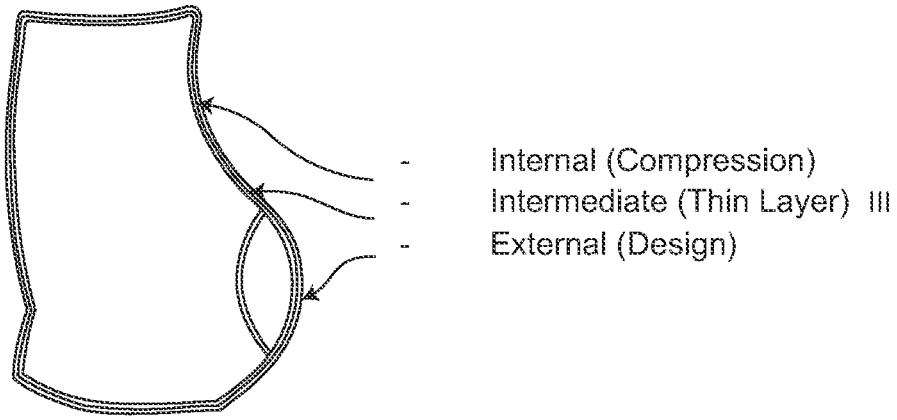
Figure 5:
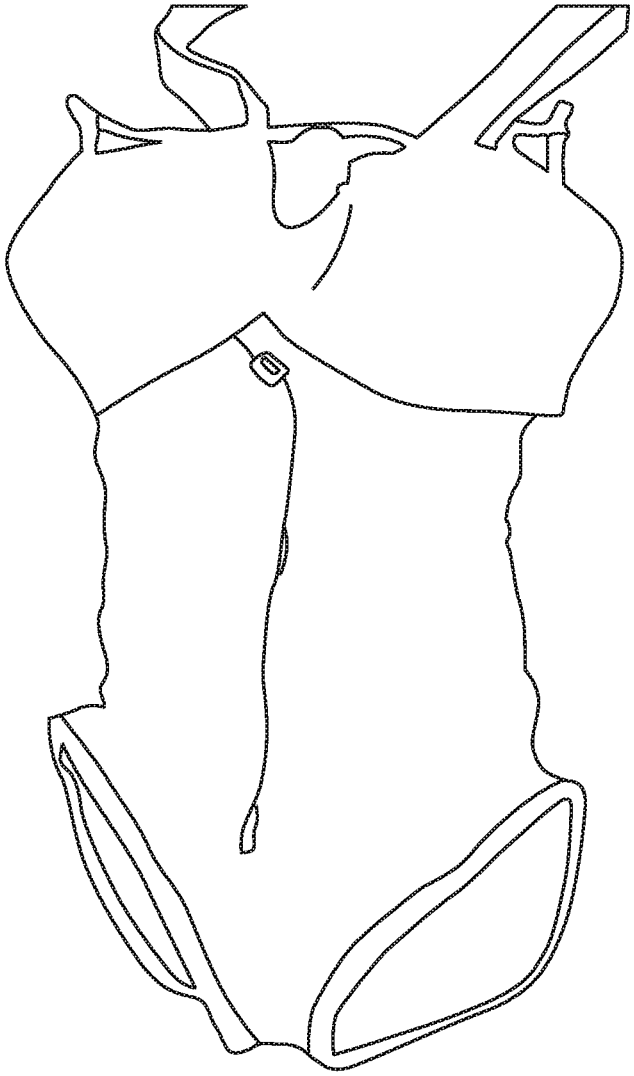
Figure 6:
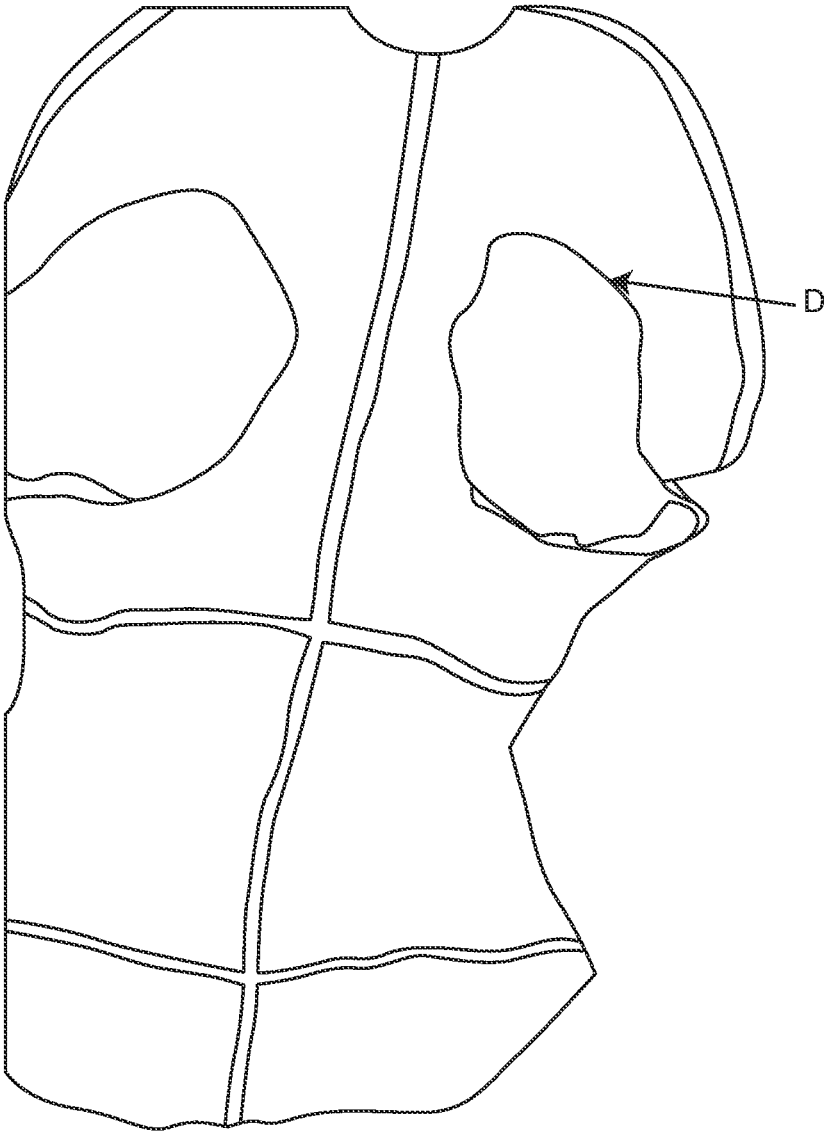
Figure 7A:
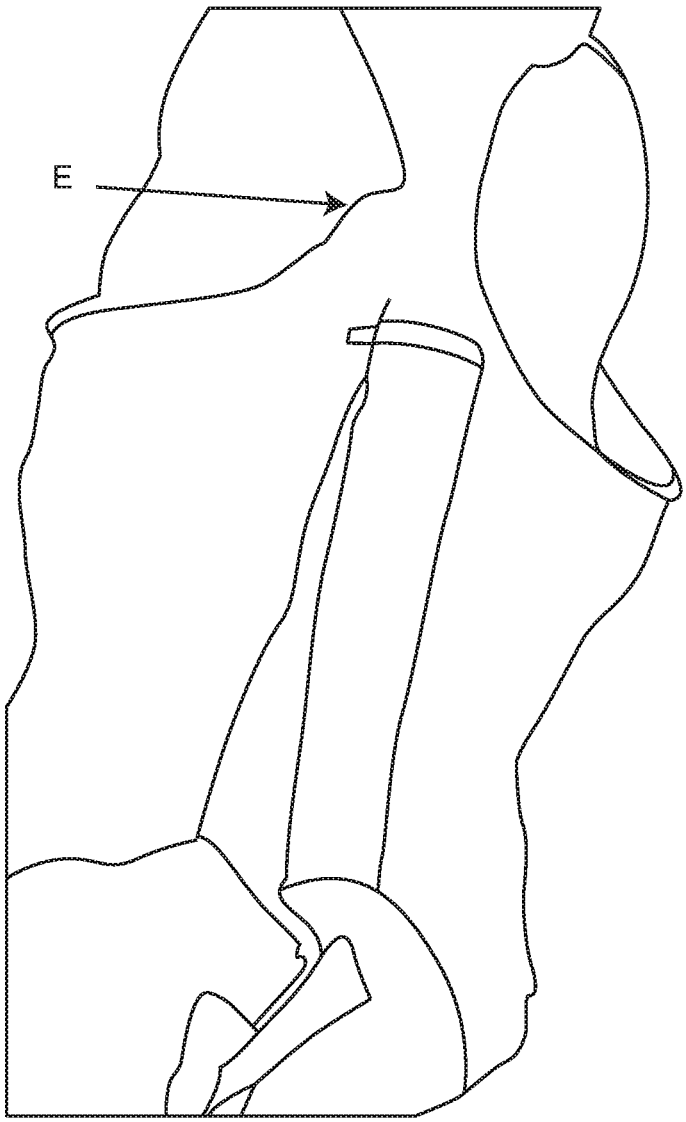
Figure 7B:
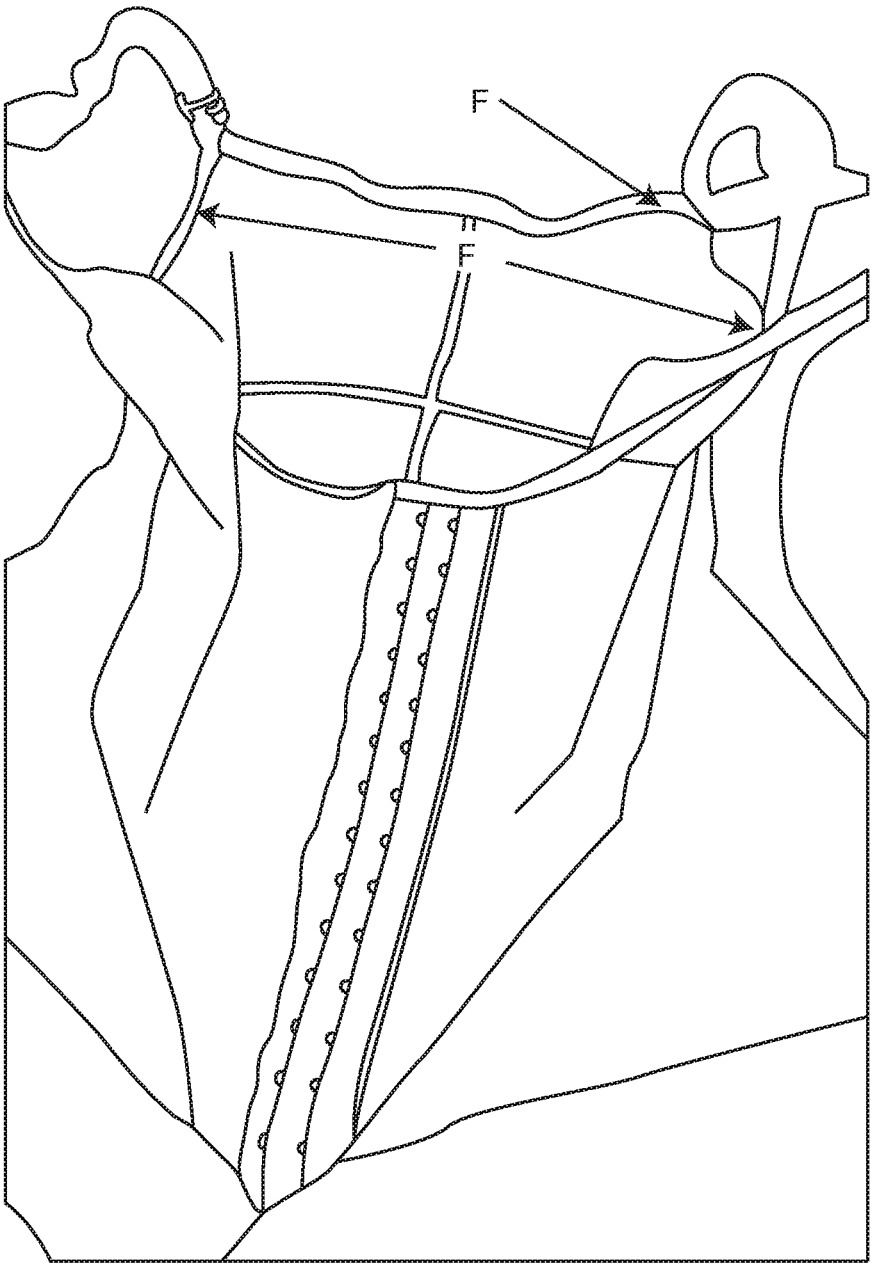
Figure 8A:
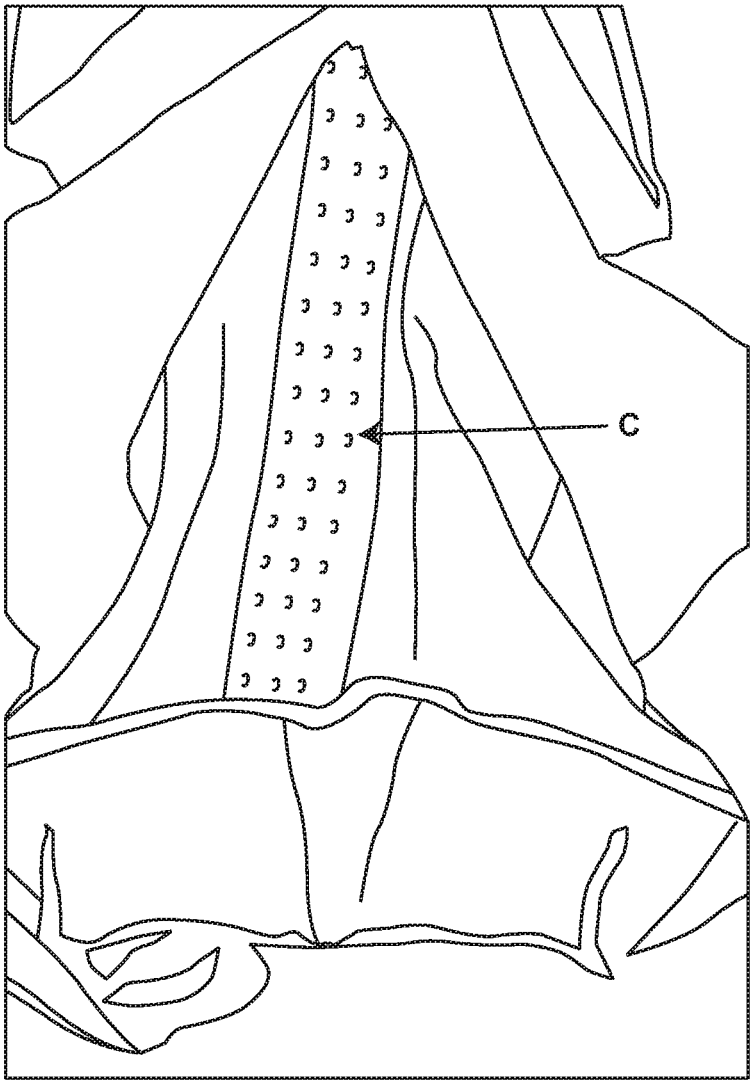
Figure 8B:
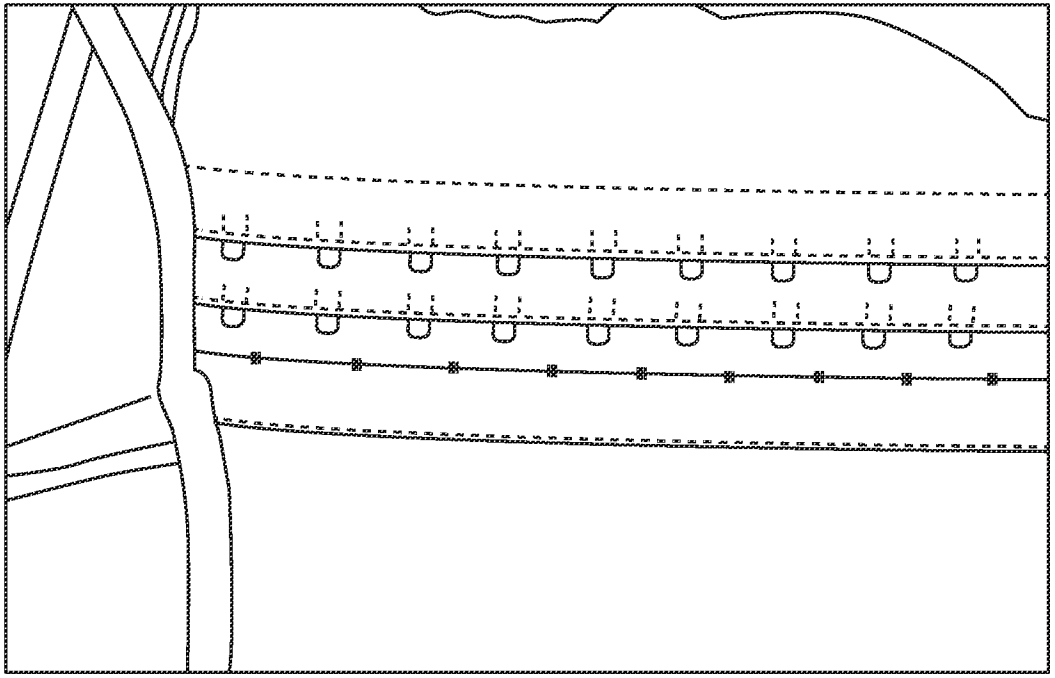

Having thus described the invention in the above general terms, reference will now be made to the accompanying drawings showing representative embodiments of the present invention, where:

FIG. 1A shows a front view of an embodiment of the outer layer (bathing suit) according to the present invention;

FIG. 1B shows a rear view of the bathing suit of FIG. 1A;

FIG. 2A shows a front view of an embodiment of the inner layer (girdle) of the bathing suit according to the present invention;

FIG. 2B shows a rear view of an embodiment of the inner layer (girdle) of the bathing suit of FIG. 2A;

FIG. 3 shows a rear view of the intermediate layer according to one embodiment of the present invention;

FIG. 4 shows a side view of the different layers that make-up the bathing suit of the present invention;

FIG. 5 shows a front view of another embodiment of the outer layer (bathing suit) according to the present invention;

FIG. 6 shows another embodiment of the inner layer (girdle) in a rear view, it is possible to observe the holes where the person's buttocks can be accommodated, as well as the intermediate layer (briefs) that covers said holes, according to the present invention;

FIG. 7A shows the points of attachment of the inner layer (girdle), according to the present invention;

FIG. 7B shows more points of attachment of the inner layer (girdle), according to the present invention;

FIG. 8A shows the inner layer (girdle) where the preferred adjustment means according to the present invention can be seen;

FIG. 8B also shows the inner layer (girdle) where the preferred adjustment means according to the present invention can be seen.

Figure 9:
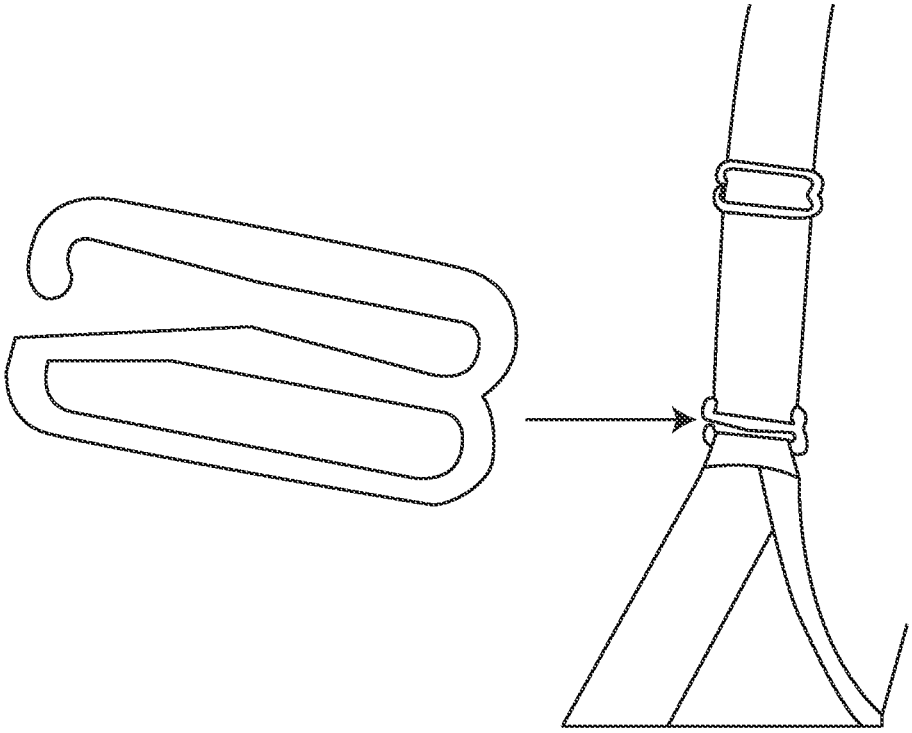
Figure 10:
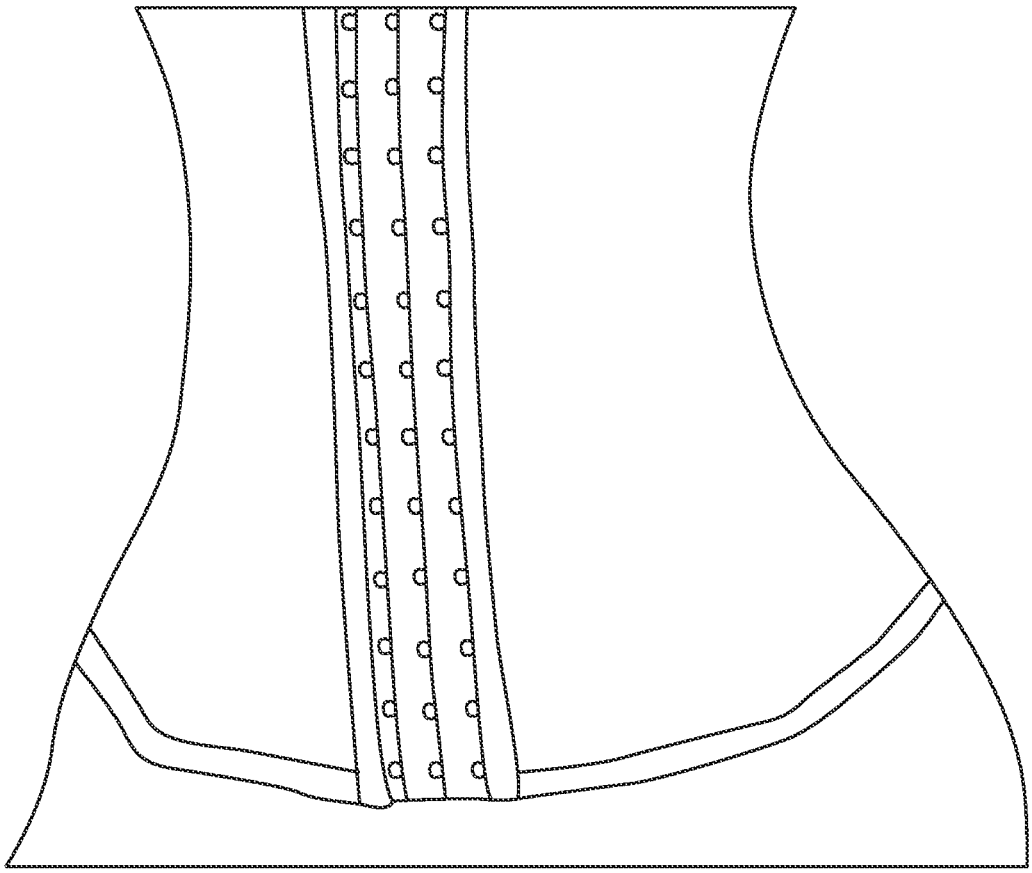
Figure 11:
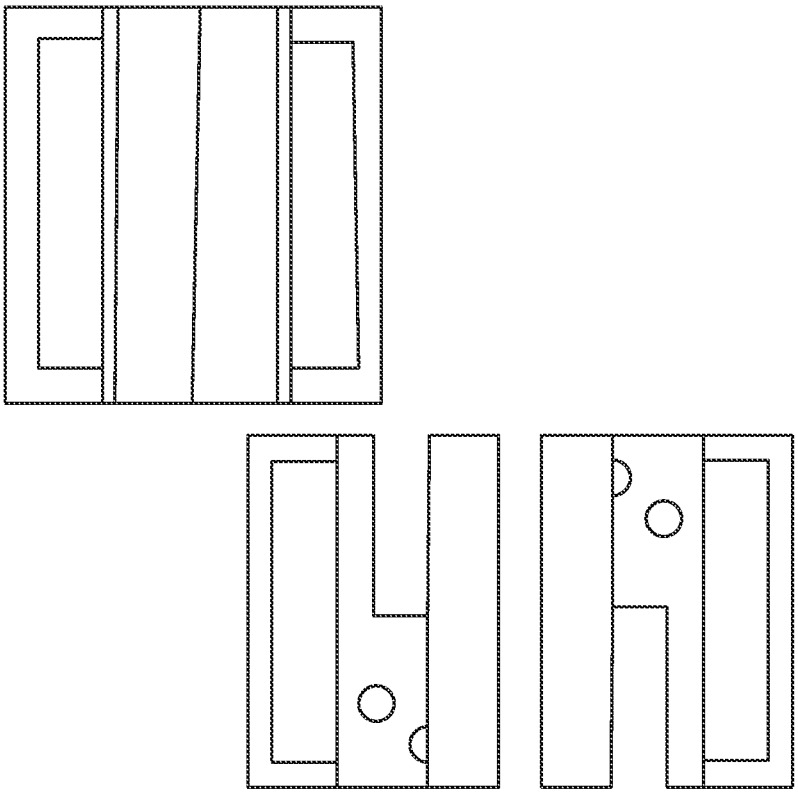
Figure 12:
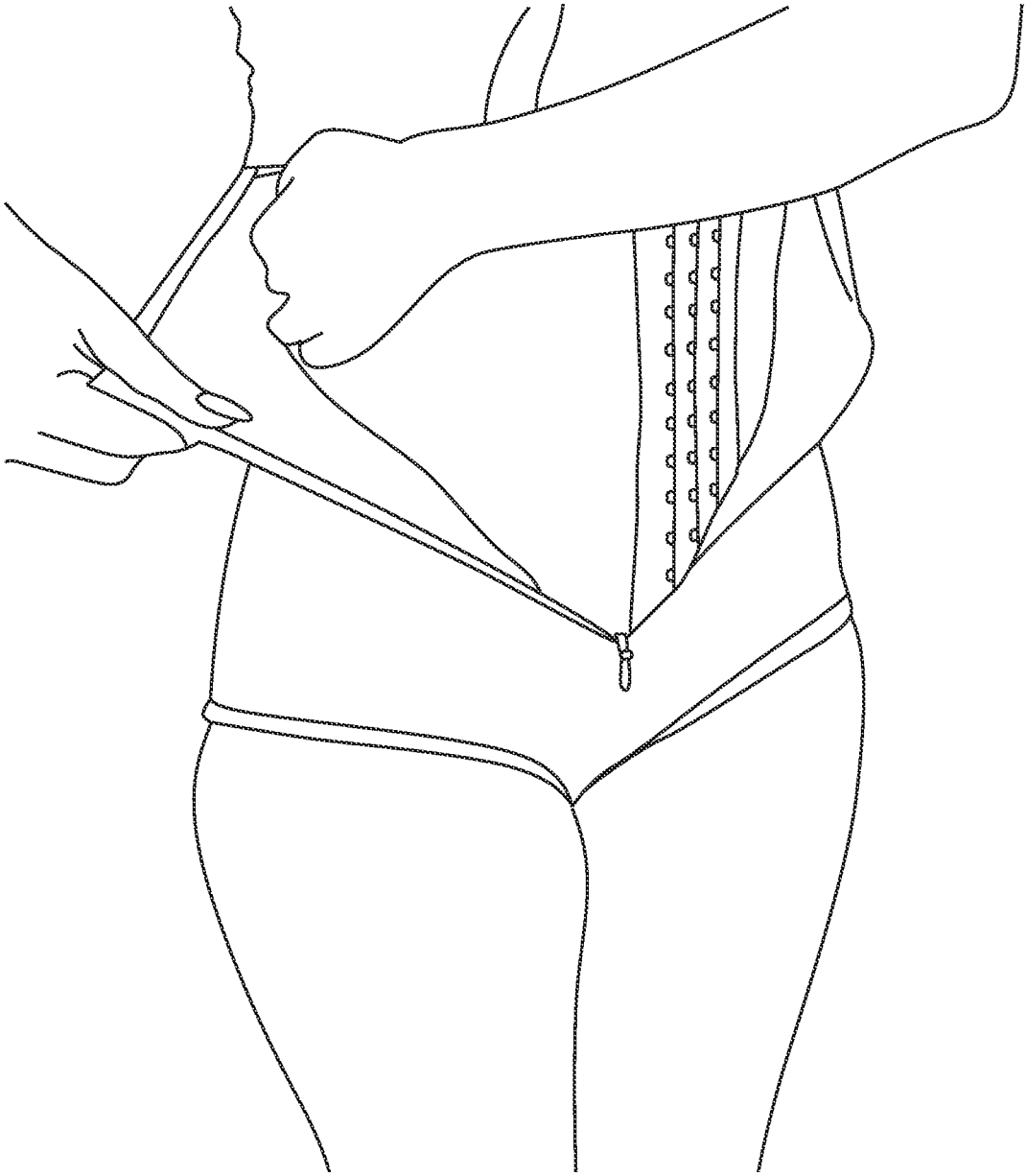
Figure 13:
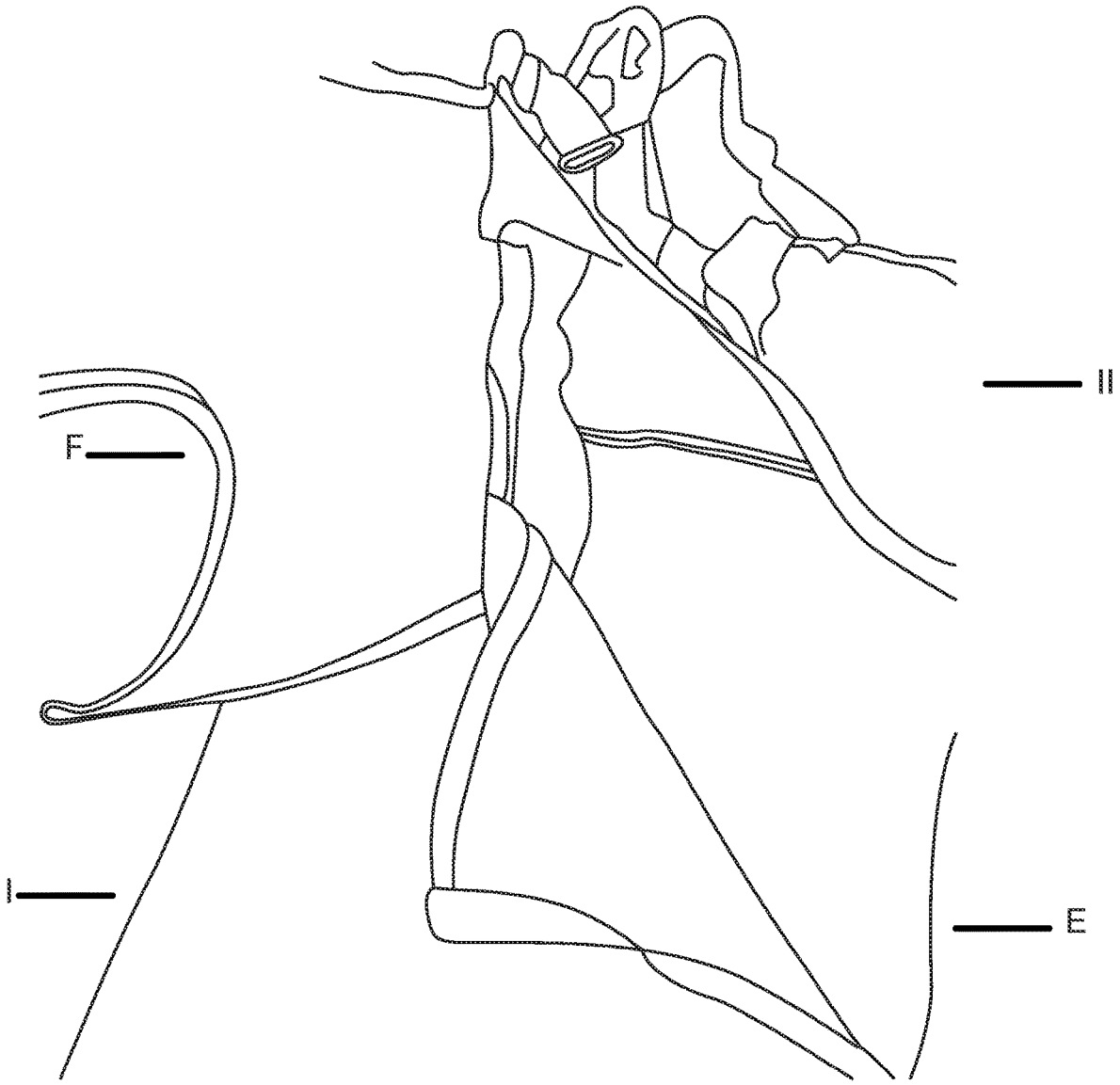
Figure 14:
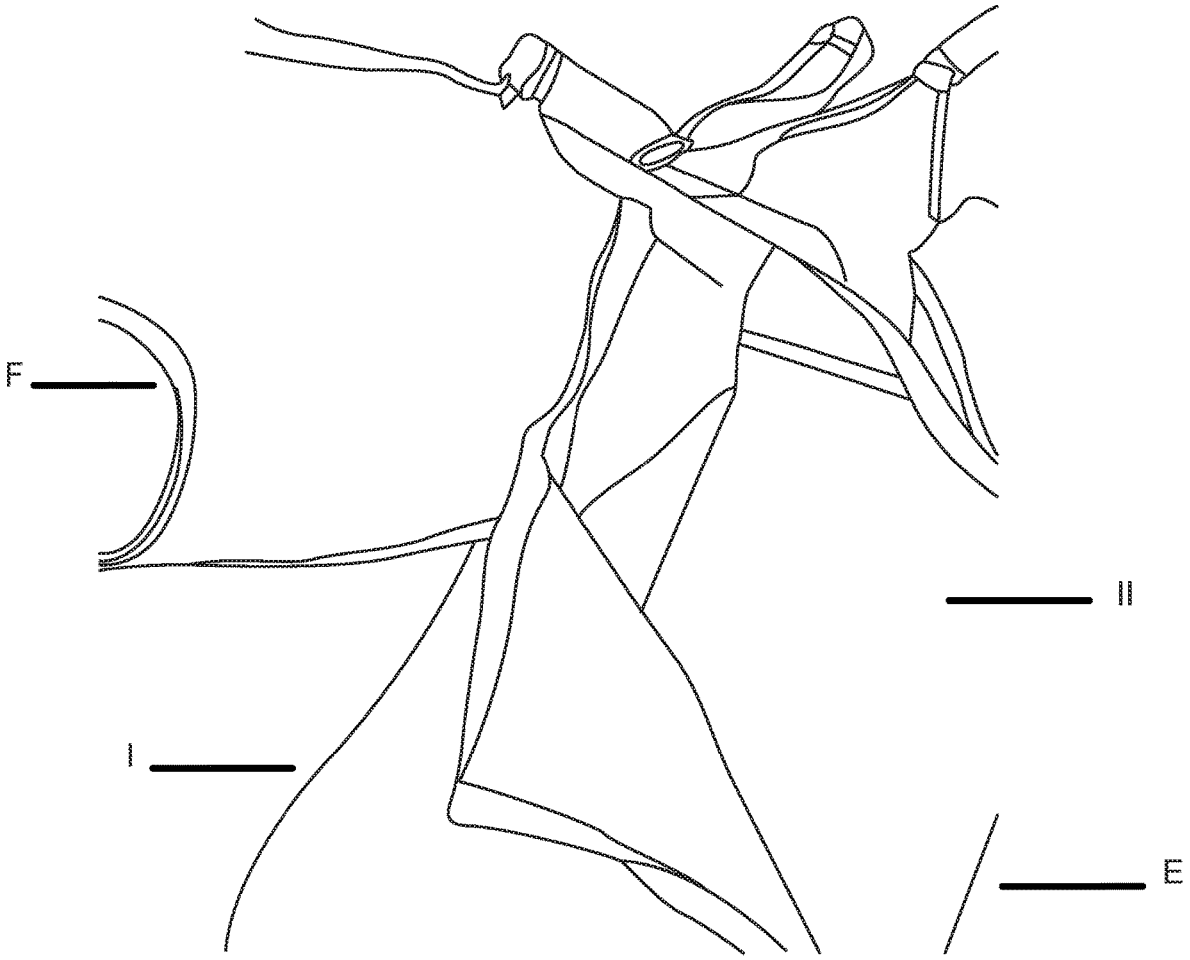
Figure 15:
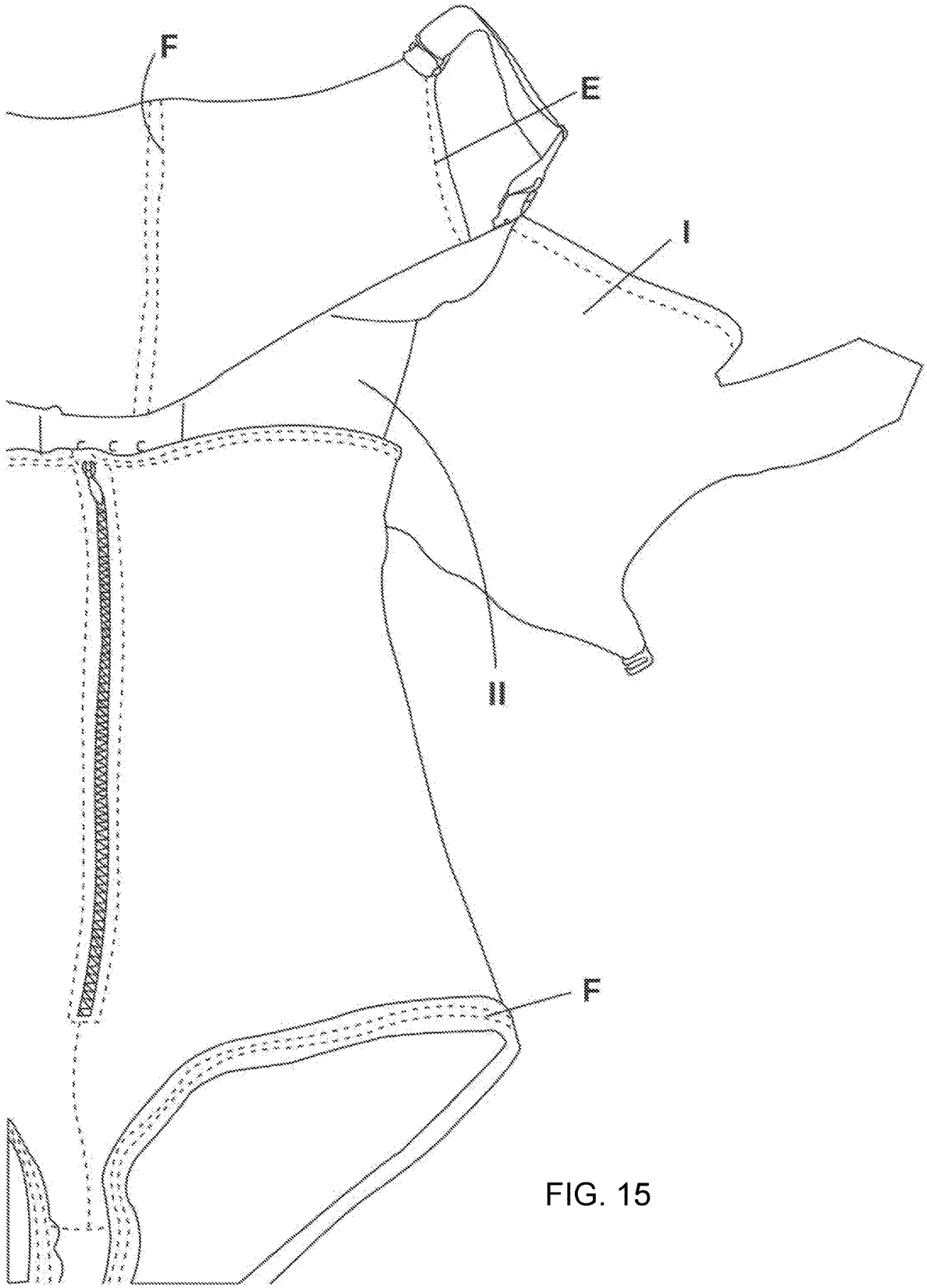

FIG. 9 shows a preferred embodiment of adjustable tie rod tensioners according to the present invention;

FIG. 10 shows a preferred embodiment of the means of closing the inner layer (girdle), according to the present invention;

FIG. 11 shows a preferred embodiment of the closure means for bra, according to the present invention;

FIG. 12 shows the arrangement of both layers according to the present invention;

FIG. 13 shows the union between said layers is through seams that are only found in the lower and upper part;

FIG. 14 shows another view of the union between said layers is through seams that are only found in the lower and upper part; and FIG. 15 shows another view of the between said layers is through seams that are only found in the lower and upper part.

DETAILED DESCRIPTION OF THE INVENTION

Some aspects of the present invention will now be described in more detail with further reference to the accompanying drawings in which some, but not all, of the advantages of the present invention are shown. Indeed, various embodiments of the invention can be expressed in many ways and should not be construed as being limited to the embodiments described herein. Rather, these exemplary embodiments are provided so that this invention will be comprehensive and complete, and will fully convey the scope of the invention to those skilled in the art. As used in the description and in the appended claims, the singular forms "a", "an", "the" include plural referents unless the context clearly indicates otherwise, also referring to the garment means also referring to the bathing suit in the present invention. Furthermore, when referring to "the person" or "the user", it should be understood as the individual who will wear, use or carry the garment or bathing suit of the present application.

With reference to the Figures, the garment of the present invention is made-up of three different layers. In FIGS. 1A, front part and in FIG. 1B back part, the first layer or outer layer (I) is shown which corresponds to a full bathing suit, and due to its characteristics completely covers the trunk of the person until reaching the legs, the bathing suit is supported by two adjustable straps (X) by means of a set of strap rings (Z), each passing over the shoulders. Said set of strap rings (Z) are, for example, like those shown in FIG. 9. Likewise, a pair of tensioners (Y) are included, which allow the garment to be adjusted in the area of the shoulders of the user.

Preferably in the center there are fastening or closure device (A) which can be a zipper, snaps, hooks or any suitable closure means. In the upper part there is also a closure device (B) for a bra (BA), which can be a hook, clasp or any suitable closure means, such as that shown in FIG. 11, for example. The fastening or closing means A and B allow the proper adjustment of the bathing suit, at the same time that they provide greater support and compression to the trunk region (abdomen and back) specifically on the skin and muscles of the person. In FIG. 5 another embodiment of the bathing suit is shown, where the outer layer is mainly observed, according to the present invention.

FIGS. 2A and 2B show an embodiment of the inner layer which refers precisely to the girdle (II). Said girdle (II) also comprises closure means (C) in the center, which can also be a zipper, snaps or any suitable closure means. For example, as shown in FIGS. 8A, 8B and 10, the closure means (C) can be a set of at least one row of hooks that are adjustable according to the type of size of the user and to the pressure required to be exerted on the skin and muscles in the abdominal and back part of the same.

FIGS. 2A and 2B also show the adjustable straps (X), which are not part as such of the girdle (II) but are included in the figure to show continuity with the outer layer (I) or bathing suit In the lower part of the girdle (II) that covers the lower back, there are a pair of holes (D) in the gluteal region of the user to place the buttocks of this, said holes (D) are also adjustable for the type of material used to make the girdle, so the users can wear the full bathing suit and have freedom of movement and comfort during use (FIG. 6).

The girdle (II) according to the present invention is attached to the outer layer (I) in a way that resembles an almost complete internal lining, however, with the aim of providing greater comfort and ease of donning, in an embodiment the girdle (II) is only attached by means of some seams (E and/or F) that are only found in the lower part and in the upper part, respectively. That is, on the thigh (below the buttocks) and/or under the armpit and on the back, as shown in FIGS. 7A and 7B. Therefore, the rest of the girdle (II) is free, which facilitates its adjustment and prevents it from losing its integral shape and adjustability during prolonged use, an example of this is shown in FIG. 12.

As can be seen in FIGS. 3 and 4, the present invention comprises an intermediate layer (III) at the bottom, which functions as an additional covering that provides even greater support and enhancement to the buttocks. Said intermediate layer (Ill) is found only in the posterior part, as detailed in FIG. 4, in the holes of the gluteal region and wherein the buttocks are incorporated.

Thus, the bathing suit of the present invention is worn in the ordinary way; for instance, in a preferred mode, leaving the closing means open, subsequently the girdle (II) is first adjusted by means of the closing means (C), its adjustment is easy since it is not necessary to place another pair of straps to support it, but rather the same pressure allows its placement; then means A and B are closed to complete the donning of the bathing suit of the present invention.

Many modifications and other embodiments of the invention can be made to those skilled in the art to which this invention pertains having the benefit of the teachings presented in the foregoing descriptions and associated drawings. Therefore, it should be understood that the specific embodiments of the invention are described herein in a non-limiting way, and that there may be modifications and other embodiments that would be included within the scope of the appended claims. Although specific terms are used herein, they are used in a generic and descriptive sense only and not for the purpose of limitation.

For example, the material from which the bathing suit and its different parts are made according to the present invention can be any woven or non-woven material, natural or synthetic that allows contact with water and also provides compression and adjustment in the trunk area (abdomen and mid-lower back) of the user wearing the present invention. These materials can be polyester, nylon or polyamide for the bathing suit, while the girdle can be made of spandex and nylon fabric.

In addition, the adjustable straps that comprise the outer layer can be, for example, as shown in FIG. 9.

Likewise, the different fastening or closing means described above are made of any material that can be submerged in water without showing signs of oxidation or any type of deterioration.

The invention claimed is:

1. A bathing suit with a full body girdle adapted to cover a trunk of a person down to the legs, the bathing suit consisting of:

an external layer including a front part, a back part, a bottom part, and a top part, a brassiere is located at the top part of the external layer, the brassiere including a pair of adjustable straps and a set of strap rings, each one of the adjustable straps is adapted to pass over the shoulders of the person, a pair of tensioners, a closure device for the bathing suit and a closure device for the brassiere, the bottom part including a pair of orifices adapted to accommodate the legs of the person;

a girdle having a closure device, and a pair of holes located on a gluteal region on a back part of the girdle, the pair of holes are adapted to accommodate and support the buttocks of the person;

an intermediate layer located between the external layer and the girdle and placed only on a back part of the external layer, the intermediate layer covering the holes of the girdle;

wherein the girdle is attached to the bathing suit as an internal lining, and wherein said bathing suit and the girdle are attached to each other through seams located below the buttocks, under armpits of the brassiere, and on the back part of the bathing suit, leaving the rest of the girdle free to facilitate its adjustment.

* * * * *